United States Patent [19]

Tanaka et al.

[11] Patent Number: 4,912,290

[45] Date of Patent: Mar. 27, 1990

[54] ELECTRIC CONTACT STRUCTURE FOR A LOCKING CYLINDER

[75] Inventors: Akira Tanaka, Saitama; Masaaki Fukamachi, Miyazaki; Kazuhiro Sakata, Miyazaki; Minoru Kawano, Miyazaki; Masami Tanaka, Miyazaki, all of Japan

[73] Assignees: Honda Giken Kogyo Kabushiki Kaisha; Kabushiki Kaisha Honda Lock, both of Japan

[21] Appl. No.: 236,052

[22] Filed: Aug. 24, 1988

[30] Foreign Application Priority Data

Aug. 25, 1987 [JP] Japan ..... 62-210541
Aug. 25, 1987 [JP] Japan ..... 62-210547

[51] Int. Cl.[4] ..... H01H 27/06
[52] U.S. Cl. ..... 200/61.66
[58] Field of Search ..... 200/11 C, 11 R, 16.66–61.68, 200/43.05, 43.08

[56] References Cited

U.S. PATENT DOCUMENTS 3,703,704 11/1972 Schiesterl et al. ..... 200/61.66 X
3,724,245 4/1973 Kitchen, Jr. ..... 200/61.66
3,806,675 4/1974 Krom et al. ..... 200/61.66 X
4,148,372 4/1979 Schroeder ..... 180/114
4,647,734 3/1987 Dana ..... 200/43.08 X

FOREIGN PATENT DOCUMENTS 62-1659 1/1987 Japan .

*Primary Examiner*—J. R. Scott
*Attorney, Agent, or Firm*—Skjerven, Morrill, MacPherson, Franklin & Friel

[57] ABSTRACT

A contact structure of a locking cylinder comprising a pair of contact pieces each extending laterally and pivoted at its one end about a pivot axis parallel to the axial line of the locking cylinder, a pair of springs, each urging the corresponding contact piece inwardly toward the center of the locking cylinder, a pair of stoppers which limit the inward motion of the contact pieces to the positions where they protrude slightly into a bore defined at the entrance to the key hole of the locking cylinder. The radially inner surfaces of the contact pieces of the locking cylinder define contact surface which electrically contact the corresponding contact pieces provided in the side edges of the base end of the shank of the key. This contact structure provides uninterrupted electric conductance between the key and the locking cylinder. To facilitate the insertion of the key into the key hole of the locking cylinder, a guide member may be fitted into the cavity defined between the contact pieces in front of the key hole so as not to interfere with the motion of the contact pieces.

4 Claims, 3 Drawing Sheets

ELECTRIC CONTACT STRUCTURE FOR A LOCKING CYLINDER

TECHNICAL FIELD

The present invention relates to an electric contact structure for a key cylinder and in particular to such a contact structure in which an electric contact can be established between a locking cylinder and a key inserted therein.

BACKGROUND OF THE INVENTION

Copending U.S. patent application No. 121,321 discloses a key device combining a common mechanical key and an infrared transmitter incorporated in the handle of the key device. The key device may be used as a remote controller for opening the door of the vehicle and, also, as an electronic code transmitter which is used in combination with the mechanical key as an ignition key of improved security. In such a case, it is advantageous to establish an electric contact between the key device and the corresponding locking cylinder for transmitting electric power from the vehicle to the handle of the key or for exchange of signals between the key device and the locking cylinder. Particularly when the handle of the key device incorporates a transmitter for locking/unlocking the door of the vehicle, the key device must be incorporated with a battery and keeping this battery electrically charged is an important requirement for satisfactory performance thereof.

Japanese Patent Laid Open Publication No. 62-1659 discloses electronic keys which are provided with connectors 18, 20, 40, 42, 52 and 54 which are electrically connected to the corresponding connectors 30, 32, 48, 50, 56 and 58 on the vehicle when the keys are inserted into the corresponding locking cylinders for the purpose of electrically charging the rechargeable batteries for these electronic keys.

However, according to this proposal, the mechanical key is ether unusual in shape or required to be made of electrically insulating material, the user must overcome a very unfamiliar feel, and, therefore, the commercial acceptability of this key structure based on this proposal may not be satisfactory. Further, the disclosure of this Japanese patent publication is limited to a conceptual structure and does not teach anything which assures the reliability of the electric contact between the key and the locking cylinder.

U.S. Pat. No. 4,148,372 discloses a contact structure in its FIGS. 2 and 3 for establishing an electric contact between the key and the locking cylinder. The key is provided with a resistor pellet 16 which serves as an electronic code. The electric contact is required here in order to obtain an electric access to the resistor pellet. According to this proposal, spring loaded contacts 18, 20, 22 and 24 are provided in the rotor for receiving the key, and are used to electrically contact not only the resistor pellet but also a pair of slip rings 26 and 28 provided in a stationary sleeve which surrounds the rotor. As shown in FIG. 1 of this patent, the contact structure is provided at the entrance to the locking cylinder. But, this structure is not suitable for applications where the short-circuiting of the contacts of the locking cylinder is not permitted because, according to the proposed invention, the contacts engage the metallic part of the key shank as it is inserted into the key hole and are electrically connected to each other. Further, each electric path contains two points of sliding contact (between the key shank and the contact engaged thereto, and between the slip ring and the contact engaged thereto), and the electric continuity may therefore not be kept at all time.

BRIEF SUMMARY OF THE INVENTION

In view of such problems of the prior art, a primary object of the present invention is to provide an electric contact structure for a locking cylinder which can be used in conjunction with a conventional mechanical key without in any way impairing the simplicity of its handling.

A second object of the present invention is to provide an electric contact structure for a locking cylinder which would not unduly increase the size of the locking cylinder.

A third object of the present invention is to provide an electric contact structure for a locking cylinder which provides an uninterrupted electric conduction even while the key is being turned.

A fourth object of the present invention is to provide an electric contact structure for a locking cylinder in which the contacts of the locking cylinder would not be short-circuited as the key is inserted into the locking cylinder.

A fifth object of the present invention is to provide an electric contact structure for a locking cylinder which is reliable and durable.

These and other objects of the present invention can be accomplished by providing an electric contact structure for a locking cylinder which is adapted to receive the shank of a key having a contact piece at the base end of the shank for establishing a mutual electric contact between electric circuits provided in the key and the locking cylinder, respectively, comprising: a fixed, hollow cylindrical sleeve defining an axial bore therein; a cylindrical rotor which is rotatably received within the bore of the hollow sleeve and defines a key hole therein; and another contact piece which is provided in the sleeve and is radially inwardly urged by spring means so as to come into contact with the contact piece of the key shank when the key shank is received in the key hole; the contact piece of the locking cylinder extends laterally across a gap defined externally of the front end surface of the rotor, and pivotally supported at its one end by the fixed sleeve about a pivot axis extending along the axial direction of the locking cylinder.

Thus, the size of the locking cylinder, in particular its outer diameter, is not required to be unduly increased for accommodating the contact piece, and a reliable conduction of electricity can be assured.

According to a preferred embodiment of the present invention, the contact piece of the locking cylinder is received in a recess provided in an inner circumferential surface of the hollow sleeve, and the recess comprises a shoulder surface which engages a part of the contact piece of the locking cylinder so as to limit an inward rotational motion of the contact piece about the pivot axis. Thereby, the contact piece of the locking cylinder would not interfere with the insertion of the key into the locking cylinder, and the short-circuiting of the contact piece of the locking cylinder with a metallic part of the key shank is effectively prevented.

When the contact piece of the locking cylinder is provided with an arcuate contact surface which establishes an electric contact with the contact piece of the key over a certain angular range defined by the expanse of the arcuate contact surface, the electric conduction accomplished by the contact pieces can be conveniently used as a source of a signal for indicating the angular position of the locking cylinder.

According to a preferred embodiment of the present invention, the front end surface of the rotor is fitted with a key shank guide member having an opening for receiving the key shank and a recess provided at its side portion for exposing the contact piece of the key shank to the contact piece of the locking cylinder laterally from the recess when the key shank is inserted into the key hole through the opening. Thereby, the provision of the contact piece of the locking cylinder does not impair the facility of inserting the key shank into the key hole of the locking cylinder which tends to be located relatively deeper in a socket defined by the outer sleeve for accommodating the contact piece.

BRIEF DESCRIPTION OF THE DRAWINGS

Now the present invention is described in the following in terms of specific embodiments thereof with reference to the drawings, in which.

DETAILED DESCRIPTION OF THE PREFERRED EMBODIMENTS

Figure 1:
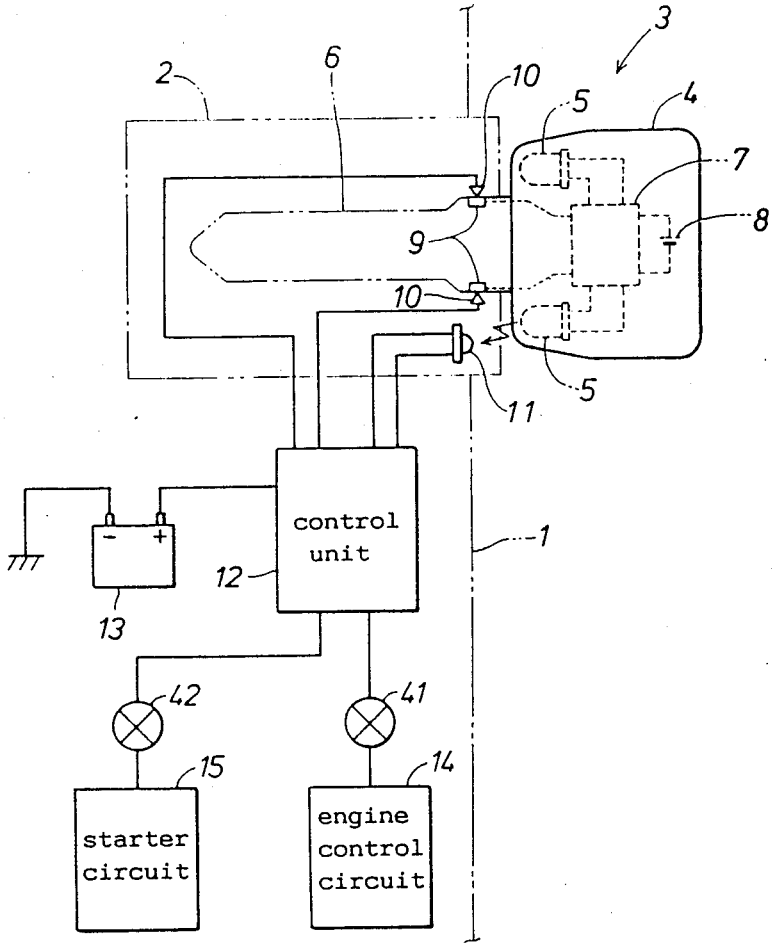
FIG. 1 is a schematic diagram showing the control circuitry of the ignition key system to which the contact structure of the present invention is applied.

FIG. 1 generally shows an engine control system to which an embodiment of the contact structure according to the present invention is applied. This system comprises a key switch unit 2, which combines a steering lock cylinder and an ignition key switch, mounted on the steering column of the vehicle 1, and a key 3 having a key shank 6 which is adapted to be inserted into the key switch unit 2 in the same way as a conventional ignition key and a handle 4 which is molded from synthetic resin material and provided with a pair of light emitting elements 5 on either side of the base end of the key shank 6 with their axial lines directed towards the tip of the key shank 6. The handle 4 further incorporates therein a control circuit 7 for the light emitting elements 5 and a rechargeable battery 8 for supplying electric power to the light emitting elements 5 and the control circuit 7. The side edges of the base end of the key shank 6 are provided with a pair of contact pieces 9 which are electrically connected to the control circuit 7.

The key switch unit 2 is provided with a pair of contact pieces 10 which can elastically contact the contact pieces 9 of the key 3 when it is inserted into the key switch unit 2, and a light receiving element 11, consisting, for instance, of a phototransistor. These contact pieces 10 and the light receiving element 11 are connected to a control unit 12 provided in the vehicle 1. The control unit 12 is connected to the on-board battery 13 of the vehicle 1, and relays 41 and 42 for controlling the operation of the engine control circuit 14 and the starter circuit 15, respectively, when the key switch unit 2 is turned to the positions of "ON" and "ST", respectively.

Figure 2:
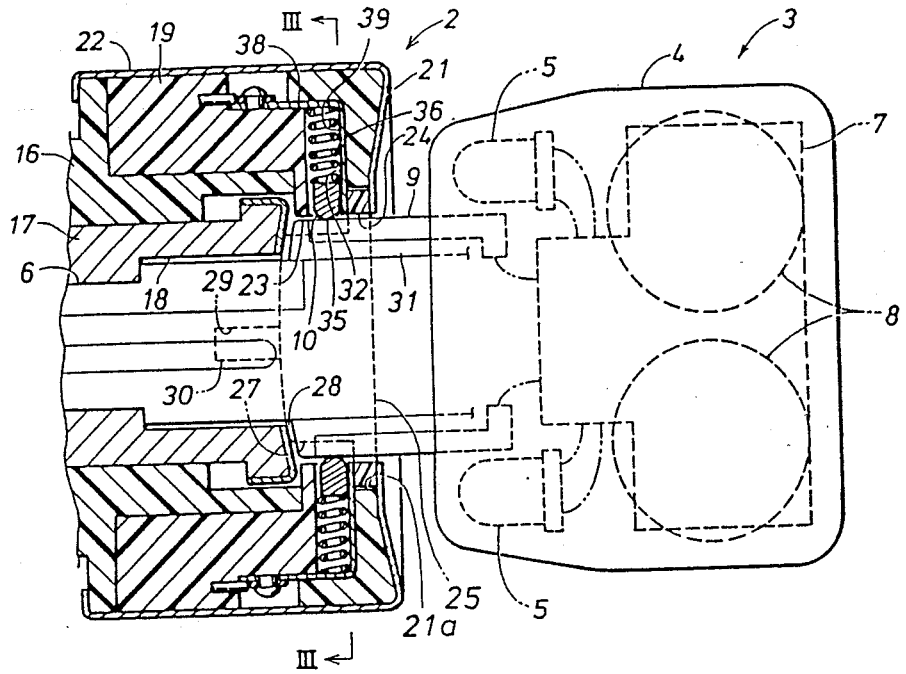
FIG. 2 is a longitudinal sectional view of a preferred embodiment of the contact structure according to the present invention.
Figure 3:
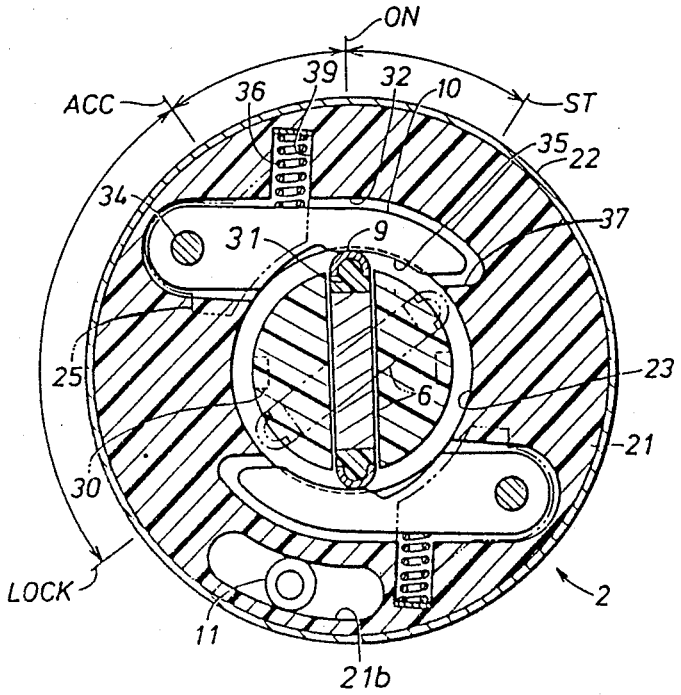
FIG. 3 is a sectional view taken along line III—III of FIG. 2.
Figure 4:
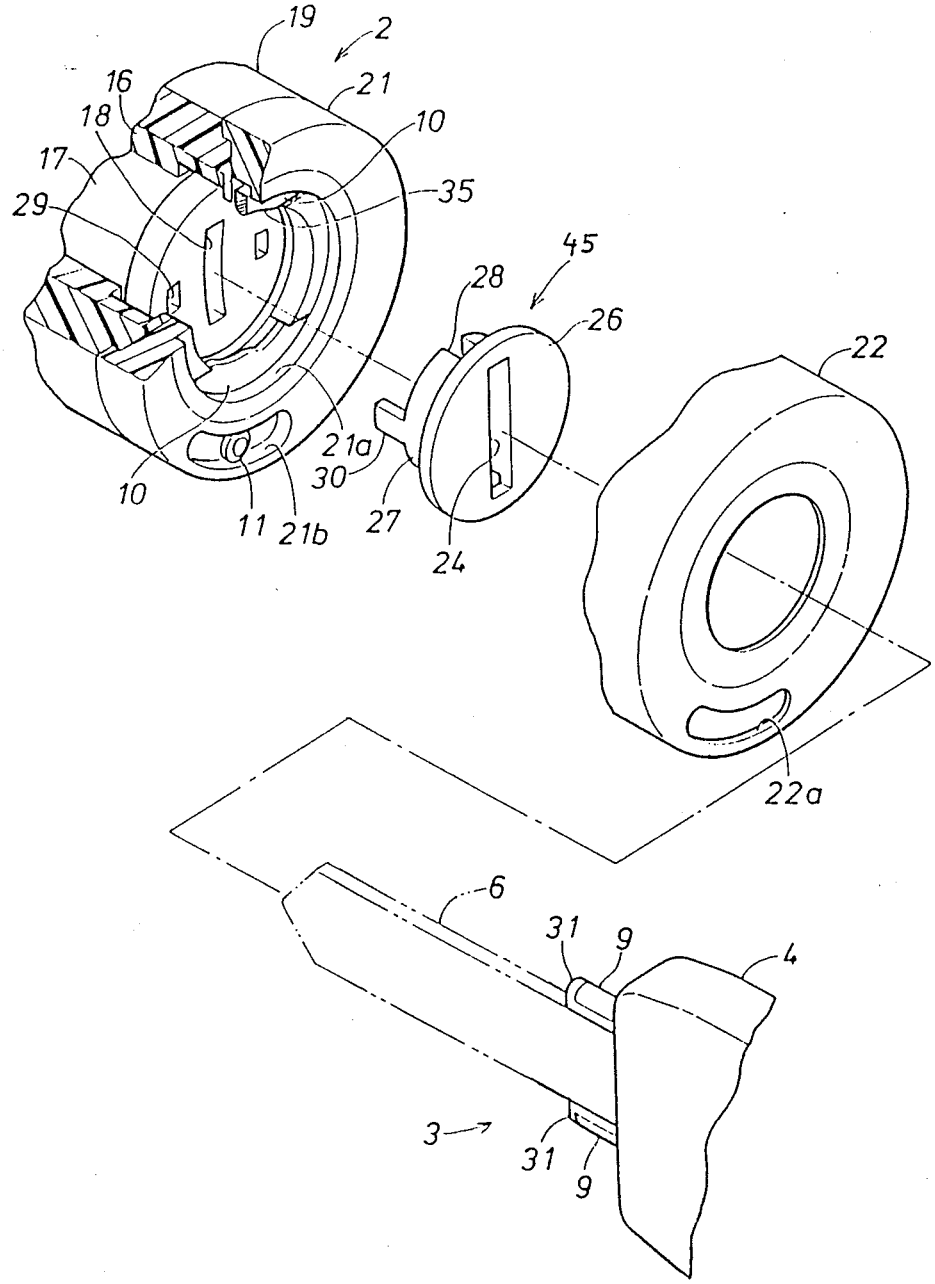
FIG. 4 is an exploded perspective view of the contact structure shown in FIGS. 2 and 3.

FIGS. 2 through 4 show essential parts of the key 3 and the key switch unit 2 when the key 3 received in the key switch unit 2 has been turned to the position "ON".

As shown in FIG. 3, the key switch unit 2 may be turned to any of a plurality of positions, "LOCK", "ACC", "ON" and "ST" for selectively permitting the actions of the engine control circuit 14, the starter circuit 15 and other on-board equipment according to the selected position. The key switch unit 2 is constructed substantially as a conventional locking cylinder, and is provided with a cylindrical outer sleeve member 16 made of synthetic resin material, and a rotor 17 which is likewise made of metallic material and is received in the outer sleeve member 16 in a rotatable manner over a certain angular range. The rotor 17 is provided with a key hole 18 for receiving the key shank 6.

A tubular inner cap 19 made of synthetic resin material is fitted onto the free end of the outer sleeve member 16 in a ooaxial manner, and covers the peripheral portion of the axial end surface thereof. A similar auxiliary cap 21 is fitted over the inner cap 19. Further, a tubular outer cap 22 made of stamp formed sheet metal covers the axial end surface of the auxiliary cap 21 and surrounds the two caps 19 and 21 and the outer sleeve member 16 by being fixed to the outer sleeve member 16 by crimping.

The inner cap 19 is provided with a coaxial and circular opening 23 whose diameter is substantially larger than the dimension of the longer side of the key hole 18. The auxiliary cap 21 is likewise provided with a coaxial and circular opening 21*a* whose diameter is substantially greater than that of the opening 23 of the inner cap 19. The width of the base end of the key shank 6 is slightly smaller than the diameter of the opening 23 of the inner cap 19. The opening 21*a* of the auxiliary cap 21 receives a disk member 45 which is described hereinafter.

FIG. 4 shows the structure of the locking cylinder as related to the disk member 45. The disk member 45 comprises a circular end plate 26 which substantially closes the opening 21*a* of the auxiliary cap 21. The end plate 26 is provided with a key introduction slot 24 for receiving the base end of the key shank 6. The slot 24 terminates at its both ends without reaching the extreme periphery of the end plate 26. The inner end surface of the end plate 26 is provided with a coaxial boss 27 having a diametral slot 28 which is passed completely through a diametral line thereof and communicated with the key introduction slot 24. The axial end surface of the coaxial boss 27 is provided with a pair of projections 30 which are adapted to be fitted into the corresponding holes 29 provided in the front end surface of the rotor 17, on either side of the key hole 18. Thus, the disk member 45 is adapted to rotate integrally with the rotor 17. Since the slot 24 of the disk member 45 defines the entry hole for the key shank 6, the user of the key has very little difficulty in inserting the tip of the key shank 6 into the key hole 18 by way of the key introduction slot 24 even though the key hole 18 is located deeper than usual in a socket defined by the inner cap 19 and the auxiliary cap 21.

A pair of terminal holders 31, having a semicircular cross section and made of electrically insulating material, are fixedly attached to either side edge of the base end of the key shank 6 and extend along the axial direction of the key shank 6. The terminal holders 31 are each covered, on the exterior, by the corresponding contact piece 9 having an arcuate cross section and made of electro-conductive material, and these contact pieces 9 are fixedly attached to the outer surfaces of the corresponding terminal holders 31. Thus, the contact pieces 9 are insulate from the key shank 6 by the terminal holders 31, and when the key shank 3 is inserted all the ay into the key hole 18, the contact pieces 9 are exposed and protrude radially from the diametral slot 28 of the boss 27 of the disk member 45.

As best shown in FIGS. 2 and 3, the auxiliary cap 21 is provided with cavities 32 which are open to the interface with the inner cap 21 as well as to the inner periphery of the opening 23, for receiving the corresponding contact pieces 10 therein. The cavities 24 further accommodate therein electro-conductive support plates 25 which are partly fixedly molded with the auxiliary cap 21. The support plates 25 are provided with upright pivot shafts 34 which pivotally support the base ends of the corresponding contact pieces 10; the radially inner surface of each of the contact pieces 10 adjacent to its free end is provided with an arcuate contact portion 35 which extends, in an arcuate manner, along the inner circumferential surface of the opening 23, from the position which is slightly away from the position "ON" towards the position "ACC", to the position corresponding to the position "ST".

To the edge of each of the corresponding contact pieces lO, opposite to the edge provided with the coaxial boss 35, elastically abuts a free end of a compression coil spring 36 which urges the corresponding contact piece 10 away from the outer periphery towards the center of the opening 23. Each of these compression coil springs 36 is received in a slot 39 formed in the radially outward direction from the corresponding cavity 24, along with a terminal piece 38 which forms a part of the corresponding support plate 25, and the base end of each of the compression coil springs 36 is engaged to the terminal piece 38 which is bent perpendicularly from the main part of the support plate 25 towards the axial direction of the key switch unit 2. The terminal pieces 38 are electrically connected to the control unit 12 which is referred to earlier. The cavities 24 are provided with shoulder surfaces (stoppers) 37 (FIG. 3) which limit the extent of the protrusion of the contact portions 35 into the opening 23. In this embodiment, the contact pieces 10 are electrically connected to the support plates 25 by way of the compression coil springs 36, but it is also possible to use a pair of lead wires to electrically connect them.

Thus, when the key shank 6 is inserted into the key hole 18 of the key switch unit 2, the contact pieces 9 are electrically connected to the control unit 12 by way of the contact pieces 10, the compression coil springs 36 and the support plates 25.

As shown in FIGS. 3 and 4, the key switch unit 2 is provided with the light receiving element 11 which faces axially outwardly from a slot **21*b* provided in the auxiliary cap 21 and a conformal opening 22*a* (FIG. 4) provided in the tubular outer cap 22. The light receiving element 11 is so arranged that it can receive the light from one of the light emitting elements 5 of the key 3 when one of the light emitting elements 5 opposes the light receiving element 11 from a region located substantially between the positions "ACC" and "ST". The light emitting elements 5 are arranged symmetric with respect to the axial line, so as to allow the key 3 to be properly inserted into the key hole 18** even when it is inverted.

In this ignition key system, the engine can be started by inserting the key 3 into the key switch 2 which is located at the position "LOCK" and turning the key all the way to the position "ST". In this embodiment, the two sets of contact pieces 9 and 10 come into mutual contact when the key switch unit 2 is turned to the position "ON" as mentioned earlier, and the electric power from the on-board battery 13 then begins to be supplied to the control circuit 7 and the rechargeable battery 8. This triggers the action of the control circuit 7, and a coded signal is transmitted from the light emitting elements 5 in the form of infrared light to the light receiving element 11 of the key switch unit 2. In the control unit 12, the received coded signal is compared with an internal code stored therein. If the codes match one another, the control unit 12 activates the engine control circuit 14 and the starter circuit 15 by way of the relays 41 and 42. Thus, the engine control circuit 14 and the starter circuit 15 are activated according to the position of the key switch unit 2, and the engine of the vehicle is accordingly controlled thereafter.

What we claim is:

1. An electric contact structure for a locking cylinder said locking cylinder being adapted to receive a shank of a key having a first contact piece, at a base end of said shank, comprising:

a fixed, hollow cylindrical sleeve defining an axial bore having an open front end;

a cylindrical rotor, rotatably mounted within said bore of said hollow sleeve, having a key hole therein for receiving said shank of said key wherein a front end surface of said rotor is sunk from said open front end of said axial bore thereby creating a cavity bounded by said front end surface of said rotor, said open first end of said axial bore, and the inner circumferential surface of said sleeve extending from said first end surface of said rotor to said open front end of said axial bore;

a second contact piece;

a pivot pin, rotatably supporting said second contact piece around an axial line in parallel with a longitudinal axis of said cylindrical sleeve so as to allow movement of a free end of said second contact piece into and out of said cavity; and spring means, operatively engaging said second contact piece, for urging said second contact piece into said cavity so that upon insertion of said key into said key hole, an electrical contact is made between said first and second contact pieces.

2. An electric contact structure as defined in claim 1, wherein said second contact piece is received in a recess provided in an inner circumferential surface of said hollow sleeve, and said recess comprises a shoulder surface which engages a part of said second contact piece so as to limit said movement of said second contact piece into said cavity around said pivot pin.

3. An electric contact structure as defined in claim 2, wherein said second contact piece is provided with an arcuate contact surface which establishes said electric contact with said contact piece of said key over a certain angular range defined by an expanse of said arcuate contact surface.

4. An electric contact structure as defined in claim 1, further comprising a key shank guide member having:

a circular end plate having an inner surface, and said circular end plate being provided with a slot for receiving said key shank therethrough;

a coaxial boss, fixedly attached to said circular end plate inner surface, said boss having a diametral slot aligned with said circular end plate slot; and a first projection integrally projecting from said boss and fixedly engaged with said rotor;

wherein said diametral slot permits a contact between said free end of said second contact piece and said first contact piece of said key shank when said key shank is inserted into said key hole through said circular end plate slot.

* * * * *